United States Patent [19]

Anderson

[11] 4,195,978

[45] Apr. 1, 1980

[54] COAL GASIFICATION PLANT

[75] Inventor: John A. Anderson, Knowle, England

[73] Assignee: British Gas Corporation, London, England

[21] Appl. No.: 954,076

[22] Filed: Oct. 24, 1978

Related U.S. Application Data

[63] Continuation of Ser. No. 744,026, Nov. 22, 1976, abandoned.

[30] Foreign Application Priority Data

Nov. 27, 1975 [GB] United Kingdom ..... 48806/75

[51] Int. Cl.[2] ..... B01J 3/00

[52] U.S. Cl. ..... 48/62 R; 48/73; 48/87; 48/202; 48/DIG. 2; 222/591; 266/236; 432/96

[58] Field of Search ..... 48/77, 76, 62 R, 92, 48/63, 202, 210, 197 R, DIG. 2; 110/165 R; 122/235 N; 164/337, 335; 266/236, 271, 195, 196, 167, 270; 222/591, 592; 75/46

[56] References Cited

U.S. PATENT DOCUMENTS

| | | | |
|---|---|---|---|
| 2,961,722 | 11/1960 | Lilljekirst et al. | 222/591 |
| 3,429,972 | 2/1969 | Bussy | 222/592 |
| 3,853,309 | 12/1974 | Widmer | 266/270 |

FOREIGN PATENT DOCUMENTS

| | | | |
|---|---|---|---|
| 266180 | 3/1966 | Australia | 48/76 |

*Primary Examiner*—S. Leon Bashore
*Assistant Examiner*—George C. Yeung
*Attorney, Agent, or Firm*—Larson, Taylor and Hinds

[57] ABSTRACT

A coal slagging gasifier and method of operating such gasifier are improved by providing an improved slag removal orifice. The orifice is located centrally within the hearth of a gasifier of the type in which hot burner gases are directed up through the orifice to retain the slag in molten condition on the hearth and in which the slag is periodically discharged through the slag removal orifice. The slag removal orifice is formed as a substantially vertical passageway through the removable slag tap member which comprises a solid cast mass of high thermal conductivity metal having an integrally formed metal tube for circulating liquid coolant through the cast mass. The upper tundish surface of the slag tap member slopes downwardly and inwardly and merges with the slag removal orifice. The coolant tube is capable of retaining its shape without any appreciable distortion during the casting of the surrounding metal mass, extends through the cast mass, and forms a coolant conduit adjacent to the tundish surface and to the surface of the orifice passageway and spaced from these surfaces a distance of 0.25 to 1.5 inches. The ends of the tube project out from the mass to provide a coolant inlet and outlet. In operation, coolant is circulated through the tube such that the surfaces of the cast mass in direct contact with slag and burner gases are maintained at a temperature of from 50° C. to 400° C.

10 Claims, 3 Drawing Figures

COAL GASIFICATION PLANT

Figure 1:
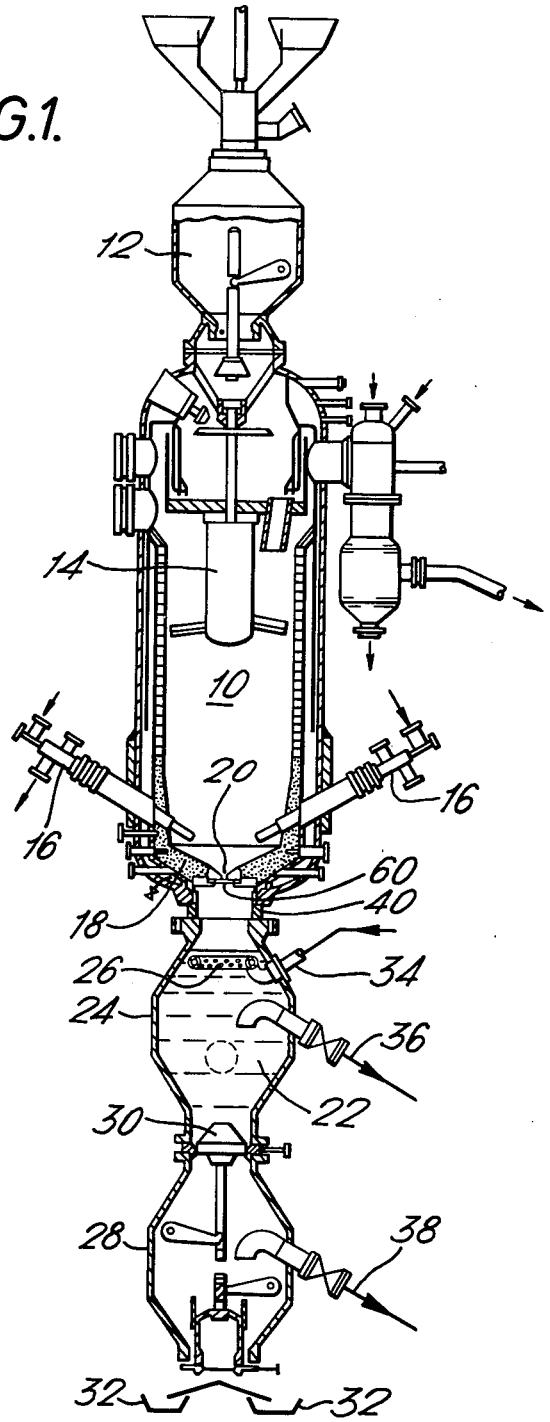

This is a continuation, of application Ser. No. 744,026 filed Nov. 22, 1976, now abandoned.

This invention relates to coal gasification plant, and more particularly to a slag outlet for use in slagging gasifier plants of the kind (hereinafter referred to as the kind specified) in which coal, or other carbonaceous fuel, is introduced into the top of a column-like gasifying vessel and is gasified under high pressure and temperature by means of oxygen and steam introduced near the fuel bed through tuyeres. The residual ash collects as a molten slag and iron in the hearth of the gasifier vessel from which it is periodically discharged (commonly known as slag-tapping) downwardly through a slag tap outlet or orifice in the hearth into water contained in a quenching chamber. Usually, a pool of molten slag and iron is maintained in the hearth by directing hot combustion products from a burner located beneath the slag tap orifice up the tap orifice to retain the pool of slag and iron in the hearth, the tapping of the molten slag and iron being initiated and controlled by stopping or reducing the burner output and reducing the pressure in the quenching chamber by controlled venting to atmosphere through its venting system so as to produce a differential pressure between the quenching chamber and the gasifier vessel.

Examples of such slagging gasifier plant are those disclosed in United Kingdom Patent Specification No. 977,122, The Gas Council Research Communications No's CC 50 and GC 112.

The containment materials of the slag tap and hearth in such slagging gasifiers are subject to aggressive erosion, corrosion and thermal attack by the slag and iron. The high temperature and mobility of the slag and iron during slag tapping and slag retention make the containment materials of the slag tap orifice and its immediate vicinity primarily subject to erosion and thermal attack by the iron. Difficulties have been experienced in providing a slag outlet for such a gasifier which does not rapidly deteriorate under the high temperature conditions and the iron present in the slag during operation of the gasifier, and an object of the present invention is to provide an improved slag tap member and a method of forming an improved slag tap member for a slagging gasifier, less subject to these disadvantages.

According to one aspect of the present invention, in a slagging gasifier of the kind hereinbefore specified, the slag-removal orifice is located centrally within the gasifier hearth and is formed as a substantially vertical passageway through a removable slag tap member, the slag tap member comprising a solid cast mass of high thermal conductivity metal having an integrally formed metal tube for circulating a coolant liquid through the cast mass, and having an upper tundish surface across which discharged slag flows, said upper surface sloping downwardly and inwardly and merging with the slag removal orifice, the coolant tube being capable of retaining its shape without any appreciable distortion during the casting of the surrounding metal mass, extending through the cast mass and forming a coolant conduit adjacent to the tundish surface and to the surface of the orifice passageway and spaced from the surfaces a distance of 0.25 to 1.5 inches, the ends of the tube projecting exteriorly of the surrounding cast metal mass to provide a coolant inlet and outlet.

In another aspect, the invention relates to a method of operating a coal slagging gasifier of the type hereinbefore specified provided with a removable slag tap member as described above in which method liquid coolant is circulated through the coolant tube at a flow rate sufficient to maintain the exposed surfaces of the cast mass in direct contact with slag and burner gases at a temperature of from 50° C. to 400° C.

The concept of controlling the rate of slag flow from the hearth reservoir through the slag tap orifice, and the resistance of erosion of the slag tap itself, depends on critical factors of design of the slag tap involving, among things, the thermal conductivity of the material used, the shape and geometry of its metal mass, the size of its orifice, and the size, length and location of its coolant passageway with respect to the surfaces of the slag tap exposed to thermal attack.

The amount and rate of flow of coolant liquid is also an important factor in the slag tap design since the exposed surfaces must be cooled efficiently to maintain acceptable surface temperatures, but on the other hand it is important that excessive quantities of heat are not removed from the hearth by the slag tap. Typically, flow velocities of the order of 20–30 ft/sec are preferred to give a constant passageway wall temperature with the range 10° C. to 20° C.

Preferably, the slag tap member is formed of copper or copper and alloyed metal.

Preferably also, the coolant passageway is of spiral form, the convolutions thereof extending at least around and near to the exposed surfaces of the slag tap member.

Conveniently, the coolant passageway may be provided by a metal tube of spirally coiled form, the ends of which project exteriorly of the surrounding metal mass to provide said inlet and outlet.

The uppermost surface of the slag tap (generally known as the tundish region) preferably slopes downwardly and inwardly and merges with the peripheral surface of the central orifice which may be of right-circular cylindrical form. The surface of revolution of the tundish may be any suitable cross-sectional profile, for example, part-circular or parabolic, through preferably it is of frusto-conical form.

In a typical operating condition of the gasifier, in which the temperature of the slag pool is of the order of 1450° C. and that of the burner gases about 1500°–1600° C., the uppermost surface or tundish of the slag tap is maintained at a temperature within the range of 200° C. to 400° C., the cylindrical surface of its orifice is maintained at a temperature within the range 100° C. to 400° C., and the lowermost surface of the slag tap adjacent the burner is maintained at a temperature within the range 50° C. to 400° C.

The slag tap member may be fabricated by forming a metal tube into a coil having an inlet and an outlet, and casting a mass of copper or copper and alloyed metal around the coil to a desired shape such that the inlet and outlet communicate exteriorly of the said cast mass.

Preferably, the coiled tube is of a metal capable of retaining its shape without any appreciable distortion during the casting process in addition to providing good thermal contact with the casting metal.

For example, the tube may be formed of nickel-chrome or nickel-chrome and alloyed metals which also have a high resistance to corrosion.

Furthermore, the external surface of the tube may be provided with means for improving the bonding with the casting metal and to reduce any tendency to stress fractures of the casting metal upon cooling after casting especially where different metals are used for the tube and casting metal.

Figure 2:
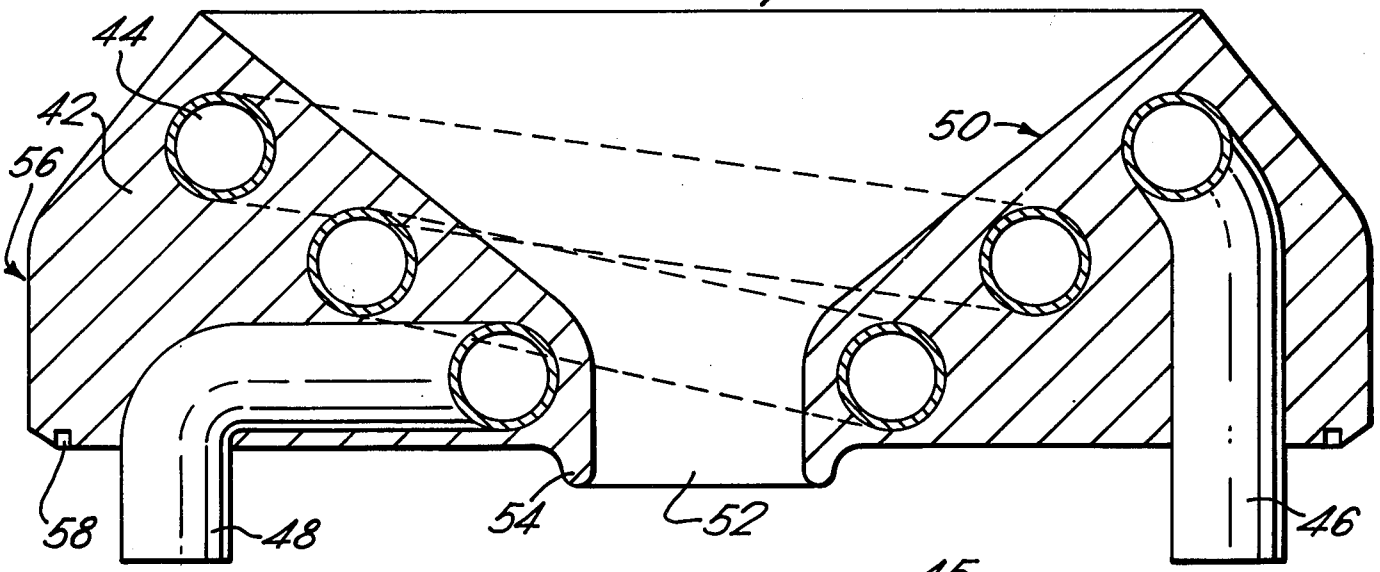
Figure 3:
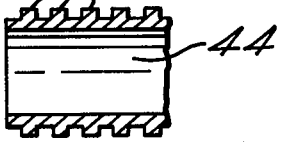

An embodiment of aspects of the invention will now be described with reference to the accompanying drawings in which:

FIG. 1 is a diagrammatic longitudinal sectional elevation of a fixed-bed slagging gasifier, FIG. 2 is a sectional elevation of the removable slag tap member of the gasifier shown in FIG. 1, and FIG. 3 is a fragmentary sectional elevation of the coiled tube in the slag tap member.

Referring first to FIG. 1, the gasifier has a refractory-lined pressurised gasification chamber 10 into which coal is fed from a lock hopper 12 and distributed by rotatable distributor means 14. Oxygen and steam are introduced into the fuel bed (not shown) through tuyeres 16 to promote gasification of the coal. In use of the gasifier, a reservoir or pool of molten slag and iron collects on the sloping hearth 18 and is periodically passed, through an orifice formed in a removable slag tap 20 supported within the hearth, into a water reservoir 22 contained in a quenching chamber 24 where it is rapidly quenched in a region of turbulent water issuing from a perforated tubular ring 26 before being transferred to a lock hopper 28 in the form of a dense small-grained frit entrained with some of the quenching water upon operation of a valve 30. The frit is discharged from the lock hopper 28 onto moving conveyors 32. Water supplied to the quench ring 26 through an inlet 34 may partly be water recirculated through outlets 36, 38 from the quenching chamber and slag lock hopper 24, 28 respectively by pump and filter means (not shown).

The quenching chamber 24 is secured in a gas tight manner to the bottom of the gasifier chamber 10 through the intermediary of a sandwich flange assembly 40. A nozzle-mixing burner 60 together with the slag tap 20 is supported by the annular flange assembly 40, but is arranged to be readily removable therefrom.

Referring now to FIG. 2, the slag tap 20 comprises a body 42 of copper or copper and alloyed metal cast around a spirally coiled pipe 44 having an inlet 46 and an outlet 48, for the circulation of coolant water, projecting from the base of the body. A tundish surface 50 of the slag tap is of frusto-conical form and merges with the cylindrical surface of a slag discharge orifice 52 which terminates in an annular lip 54. The outer peripheral surface 56 of the body 42 is preferably tapered so as to facilitate easy removal from the hearth of the gasifier. An annular recess 58 is provided in the base of the body 42 for co-axial engagement with an annular projection (not shown) on the sandwich flange assembly.

In a specific example of a slag tap, the coiled pipe 44 was formed of nickel-chrome alloy, for example Inconel 600, about 42 inches in length, with an inside diameter of 0.5 inch and wall thickness of 0.125 inch. The overall width of the cast body 42 was about 12.75 inches with an overall height of about 4.5 inches. The diameter of the orifice 52 was 2 inches, and 1.5 inches in height, merging into the tundish surface which is at an angle of 38° to the horizontal. Preferably, the outer surface of the cast-in length of the coiled pipe is formed with a plurality of spaced annular ribs 45 (See FIG. 3) for improving the bond with the casting metal which enhances heat transmission to the coolant liquid, and to obviate any tendency to fracture of the casting upon cooling after the casting process. The coiled pipe is located within the cast body so that the convolutions thereof extend at least around and adjacent the surfaces of the tundish and orifice, and preferably, those convolutions which are adjacent said surfaces are spaced therefrom to between 0.25 inch and 1.5 inches. The slag tap is made by first forming the pipe 44 into the desired spirally coiled form, supporting the pipe by suitable means in a suitable mould from which the inlet 46 and outlet 48 protrude, and casting copper or copper alloy in the mould to form the body 42. This method of manufacture gives a good contact and thus heat transmission between the body 42 and the coolant conduit formed by the pipe 44.

I claim:

1. In a coal slagging gasifier comprising: a gasifying vessel; means for introducing coal into said vessel for gasification thereof in said vessel; means for introducing oxygen and steam into said vessel to effect gasification of coal therein; a hearth located at the bottom of said vessel and including a slag removal orifice for removing slag therefrom; burner means located beneath the slag removal orifice for directing a flow of hot combustion products up the slag removal orifice to retain the slag in a molten condition on said hearth; a quenching chamber positioned below said slag removal orifice for receiving slag discharged through said slag removal orifice; and means for reducing or stopping said flow of hot combustion gases for discharging slag through said slag removal orifice; the improvement wherein said slag-removal orifice is located centrally within said hearth and is formed as a substantially vertical passageway through a removable slag tap member, said slag tap member comprising a solid cast mass of high thermal conductivity metal having an integrally formed metal tube for circulating a coolant liquid through said cast mass, and having an upper tundish surface across which discharged slag flows, said upper surface sloping downwardly and inwardly and merging with said slag removal orifice, said coolant tube being capable of retaining its shape without any appreciable distortion during the casting of the surrounding metal mass, extending through said cast mass and forming a coolant conduit adjacent to said tundish surface and to the surface of said orifice passageway and spaced from said surfaces a distance of 0.25 to 1.5 inches, the ends of said tube projecting exteriorly of the surrounding cast metal mass to provide a coolant inlet and outlet.

2. An improved coal slagging gasifier according to claim 1 wherein said slag tap member comprises copper or copper and alloyed metal.

3. An improved coal slagging gasifier according to claim 1 wherein said coolant tube is of spiral form.

4. An improved coal slagging gasifier according to claim 1 wherein the peripheral surface of the central slag-removal orifice is of right-circular cylindrical form.

5. An improved coal slagging gasifier according to claim 1 wherein the surface of revolution of said upper tundish surface is of frusto-conical form.

6. An improved coal slagging gasifier according to claim 1 wherein the external surface of said coolant tube comprises means for improving bonding to the cast mass.

7. An improved coal slagging gasifier according to claim 6 wherein said bonding improving means comprises a plurality of spaced apart annular ribs attached to the outer surface of said tube and in intimate contact with said mass.

8. In a method of gasifying coal in a coal slagging gasifier comprising introducing coal, oxygen and steam into a gasifying vessel, maintaining the temperature within said gasifier sufficient to gasify the coal and to form molten slag in a hearth at the bottom of said vessel, directing hot combustion products from a burner located beneath a slag tap orifice located in said hearth up the slag tap orifice to retain the molten slag in said hearth, and periodically discharging slag downwardly through said slag tap orifice: the improvement wherein said slag tap orifice is located centrally within said hearth and is formed as a substantially vertical passageway through a removable slag tap member, said slag tap member comprising a solid cast mass of high thermal conductivity metal having an integrally formed tube for circulating a coolant liquid through said cast mass, and having an upper tundish surface across which discharged slag flows, said upper surface sloping downwardly and inwardly and merging with said slag removal orifice, said coolant tube being capable of retaining its shape without any appreciable distortion during the casting of the surrounding metal mass, extending through said cast mass and forming a coolant conduit adjacent to said tundish surface and to the surface of said orifice passageway and spaced from said surfaces a distance of 0.25 to 1.5 inches, the ends of said tube projecting exteriorly of the surrounding cast metal mass to provide a coolant inlet and outlet, and circulating coolant liquid through said coolant tube at a flow rate sufficient to maintain the exposed surfaces of said cast mass in direct contact with slag and burner gases at a temperature of from 50° C. to 400° C.

9. An improved method according to claim 8 wherein the upper tundish surface of the slag tap member is of frusto-conical form, wherein the central slag removal orifice is of right circular cylindrical form and wherein said coolant is circulated at a flow rate such that said upper tundish surface is maintained at a temperature of from 200° to 400° C., the cylindrical surface of the orifice is maintained at a temperature of from 100° to 400° C., and the lowermost surface of the slag tap adjacent the burner is maintained at a temperature of from 50° to 400° C.

10. An improved method according to claim 8 wherein said slag tap member comprises copper or copper and alloyed metal.

* * * * *